US009744560B2

(12) United States Patent
Fritz et al.

(10) Patent No.: US 9,744,560 B2
(45) Date of Patent: Aug. 29, 2017

(54) PAINTING METHOD AND PAINTING FACILITY FOR DECORATIVE STRIPES

(71) Applicant: Durr Systems GmbH, Bietigheim-Bissingen (DE)

(72) Inventors: Hans-Georg Fritz, Ostfildern (DE); Benjamin Wohr, Eibensbach/Guglingen (DE); Marcus Kleiner, Besigheim (DE); Timo Beyl, Besigheim (DE); Frank Herre, Oberriexingen (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 0 days.

(21) Appl. No.: 14/766,460

(22) PCT Filed: Feb. 5, 2014

(86) PCT No.: PCT/EP2014/000310
§ 371 (c)(1),
(2) Date: Aug. 7, 2015

(87) PCT Pub. No.: WO2014/121927
PCT Pub. Date: Aug. 14, 2014

(65) Prior Publication Data

US 2016/0001322 A1 Jan. 7, 2016

(30) Foreign Application Priority Data

Feb. 11, 2013 (DE) ..... 10 2013 002 433

(51) Int. Cl.
*B05D 1/34* (2006.01)
*B05D 1/36* (2006.01)
(Continued)

(52) U.S. Cl.
CPC ..... *B05D 7/14* (2013.01); *B05D 1/02* (2013.01); *B05D 1/34* (2013.01); *B05D 1/36* (2013.01);
(Continued)

(58) Field of Classification Search
CPC ... B05D 1/34; B05D 1/36; B05D 1/38; B05D 5/06; B05D 5/066; B05D 7/14;
(Continued)

(56) References Cited

U.S. PATENT DOCUMENTS 8,071,170 B2 12/2011 Kamimori et al.
8,794,174 B2 * 8/2014 Herre ..... B05B 13/0221 118/300
2004/0028823 A1 2/2004 Dutt
2004/0175551 A1 9/2004 Dunlop et al.
2004/0217202 A1 11/2004 Hynes
2007/0172692 A1 7/2007 Kamimori et al.
2009/0074968 A1 3/2009 Dunlop et al.
2009/0117283 A1 5/2009 Herre et al.
(Continued)

FOREIGN PATENT DOCUMENTS

DE 102010014381 A1 10/2011
DE 102010019612 A1 11/2011
(Continued)

OTHER PUBLICATIONS

International Search Report for PCT/EP2014/000310 dated May 21, 2014 (with English translation; 5 pages).
(Continued)

*Primary Examiner* — Bruce H Hess
(74) *Attorney, Agent, or Firm* — Bejin Bieneman PLC

(57) ABSTRACT

A method for painting a component such as a motor vehicle body component includes applying to the component a base coat layer, a pattern such as a decorative strip or a graphic element, and applying a clear lacquer coat. The pattern (7) is applied to the base coat layer without interposing a clear lacquer coat. A corresponding painting facility is provided.

12 Claims, 13 Drawing Sheets

(51) Int. Cl.

| | |
|---|---|
| ***B05D 1/38*** | (2006.01) |
| ***B05D 5/06*** | (2006.01) |
| ***B05D 7/14*** | (2006.01) |
| ***B05D 7/24*** | (2006.01) |
| ***B05D 7/00*** | (2006.01) |
| ***B05D 1/02*** | (2006.01) |
| ***B05D 3/04*** | (2006.01) |

(52) U.S. Cl.
CPC ..... *B05D 1/38* (2013.01); *B05D 3/04* (2013.01); *B05D 5/066* (2013.01); *B05D 7/572* (2013.01); *B05D 7/574* (2013.01); *B05D 7/577* (2013.01); *B05D 7/5783* (2013.01); *B05D 7/5785* (2013.01); *B05D 5/06* (2013.01)

(58) Field of Classification Search
CPC ..... B05D 7/24; B05D 7/572; B05D 7/574; B05D 7/577; B05D 7/5783; B05D 7/5785
USPC ..... 428/204; 427/258
See application file for complete search history.

(56) References Cited

U.S. PATENT DOCUMENTS

| | | | |
|---|---|---|---|
| 2013/0224497 | A1 | 8/2013 | Warta et al. |
| 2013/0284833 | A1 | 10/2013 | Fritz et al. |

FOREIGN PATENT DOCUMENTS

| | | | |
|---|---|---|---|
| EP | 1810757 | A1 | 7/2007 |
| EP | 2208541 | A2 | 7/2010 |
| EP | 2367639 | A1 | 9/2011 |
| GB | 2399040 | A | 9/2004 |
| WO | 2007131660 | A1 | 11/2007 |
| WO | 2010069467 | A1 | 6/2010 |

OTHER PUBLICATIONS

Buzer, Gunter et al.; Durr News; Jun. 2006; pp. 1, 6, 7, 11; Jun. 2006 (with English Text; 8 pages).

* cited by examiner

PAINTING METHOD AND PAINTING FACILITY FOR DECORATIVE STRIPES

CROSS-REFERENCE TO RELATED APPLICATIONS

This application claims priority to Patent Cooperation Treaty Patent Application No. PCT/EP2014/000310, filed on Feb. 5, 2014, which claims priority to German Application No. DE 10 2013 002 433.1, filed Feb. 11, 2013, each of which applications are hereby incorporated herein by reference in their entireties.

BACKGROUND

When painting motor vehicle bodywork components, normally several paint layers are applied, namely, amongst others, a layer consisting of a cathode dip coat (CDC), a filler layer, a base coat layer and, on the very outside, a clear coat layer. Furthermore, it is known to apply decorative lines, design stripes, patterns or graphics to the component. For example, decorative stripes are applied to the clear coat layer by means of a brush. After drying of the manually applied decorative stripe, a further clear coat layer is then applied and baked.

FIG. 1 shows as an example the multi-layer construction of such a conventional paint on a motor vehicle bodywork component 1. The paint consists of a phosphate layer 2, a primer 3 of a cathode dip coat (CDC), a filler 4, a base coat layer 5, a clear coat layer 6, a pattern 7 (e.g., decorative stripe), and a further clear coat layer 8 applied to the pattern 7.

FIG. 2 shows, accordingly, in the form of a flow diagram, the painting method for applying the paint in FIG. 1. The flow diagram here begins in step S1 with application of the primer 3 comprising the cathode dip coat, but in a preceding method step the phosphate layer 2 may also be applied, which is not shown here. In a step S2, the filler layer 4 is then applied. Then, in step S3, the base coat layer 5 is applied. In step S4, the base coat layer 4 is dried. After the base coat layer has dried, the clear coat layer 6 is applied in step S5. Then the clear coat layer is baked in step S6. Then, in step S7, the pattern 7 is applied manually, for example in the form of a decorative stripe which may be applied manually with a brush. Then, in step S8, the pattern 7 is subjected to intermediate drying. Finally, in step S9, the further clear coat layer 8 is applied and baked in step S10.

The disadvantages with this known method for applying a pattern (e.g., decorative stripes) include firstly the fact that the additional clear coat layer 8 is required. Associated with this is the need for a further drying step.

A further disadvantage of the known painting method described above is that the pattern 7 is applied manually. Usually masking material (e.g., films, adhesive tapes) is required to mask of the component surface corresponding to the desired pattern 7, wherein the provision and disposal of the masking material is associated with additional costs. Furthermore, manual application of the pattern 7 leads to a relatively high number of faults.

DE 10 2010 014 381 A1 discloses a painting method in which a pattern is applied directly to the base coat layer, i.e., without an intermediate clear coat layer. However, here the pattern is formed from a layer composite which comprises a carrier and a hardened paint layer. The layer composite is here pressed with the hardened paint side onto the base coat layer, after which the carrier may be removed. Application of the pattern here does not take place as part of a painting process, and is therefore substantially more expensive.

Also, reference is made to US 2004/0028823 A1 for the prior art. Here, however, no pattern is applied in the sense of the present disclosure.

The prior art moreover comprises WO 2007/131660 A1, the company publication "Dürr News Juni 2006 Ausgabe", and DE 10 2010 019 612 A1.

SUMMARY

The present disclosure includes painting a component, in particular a motor vehicle bodywork component. The present disclosure furthermore comprises a painting facility and a paint layer produced on a component, in particular on a motor vehicle bodywork component.

The present disclosure comprises the general technical teaching of applying the pattern (e.g., decorative stripe) to the base coat layer without an intermediate clear coat layer, so that no additional clear coat layer is required over the pattern. In the context of the painting method according to the present disclosure, preferably therefore only a single clear coat is applied which covers not only the base coat layer but also the pattern.

The phrase "application of a pattern" in the context of the present disclosure relates primarily to painting methods such as, for example, spraying processes or printing processes. The pattern is thus preferably applied by an atomiser (e.g., a rotary atomiser). In this way, the present disclosure is distinguished from publication DE 10 2010 014 381 A1 cited above, in which a layer composite (carrier+hardened paint layer) is pressed on.

The concept of a pattern in the context of the present disclosure is not restricted to the above-mentioned decorative, design or decor stripes. Rather, the concept of the pattern in the context of the present disclosure also includes graphics, images and the like. A further example of a pattern is the painting of a part surface (e.g., a roof bar of a vehicle bodywork) which is to be painted in a different colour from the other vehicle bodywork. In general, the concept of a pattern in the context of the present disclosure comprises any areas of a component surface that are to be coated with a different coating agent (e.g., in another colour) from the rest of the component surface. The concept of a pattern used in the context of the present disclosure preferably means that the pattern covers only a part area of the component surface, i.e., not the entire component surface. Furthermore, the concept of a pattern can mean that the pattern is not superficially continuous, but instead covers the component surface only at the respective pattern details (e.g., lines).

In an exemplary embodiment, the pattern is applied directly onto the base coat layer. This means that there is neither a clear coat layer nor any other layer of another material between the base coat layer and the pattern.

In one variant, the base coat layer is merely flash-dried before application of the pattern, and the pattern (e.g., decorative stripe) is also merely flash-dried before application of the clear coat.

In another variant, the base coat layer is, however, subjected to intermediate drying before application of the pattern, whereas the pattern is merely flash-dried before application of the clear coat.

Yet another variant includes flash-drying the base coat layer before application of the pattern, while the pattern is subjected to intermediate drying before application of the clear coat.

Furthermore, the base coat layer may be subjected to intermediate drying before application of the pattern, and the pattern could be also subjected to intermediate drying before application of the clear coat.

In yet another variant, the base coat layer and the pattern are applied wet-on-wet without intermediate drying or flash-drying. This means that the pattern is applied at a time at which the underlying base coat layer is still not completely dry, so that the wet paint of the pattern hits the still-wet paint of the base coat layer in a process known as "wet-on-wet painting".

Furthermore, in the context of the present disclosure, it is possible that the base coat layer, the pattern (e.g., decorative stripe), and the clear coat layer, are applied wet-on-wet in a so-called 3-wet process without intermediate drying or flash-drying. This means that the liquid paint of the pattern is applied at a time at which the underlying base coat layer is still not completely dry. This also means that the liquid clear coat is applied at a time at which the underlying paint of the pattern is still not completely dry. In a 3-wet process, the three paints (base coat, pattern paint and clear coat) of the three superimposed paint layers are therefore at least briefly all in a liquid state together.

In one exemplary embodiment, the base coat layer and the pattern (e.g., decorative stripe) are applied together in one paint booth, in particular in the above-mentioned wet-on-wet process without intermediate drying or flash-drying.

In another exemplary embodiment, the pattern (e.g., decorative stripe) and the clear coat layer are applied together in one paint booth, e.g., in the above-mentioned wet-on-wet process without intermediate drying or flash-drying.

In yet another exemplary embodiment, the base coat layer, the pattern and the clear coat layer are applied together in one paint booth, e.g., in the above-mentioned 3-wet process without intermediate drying or flash-drying.

There is, however, also the possibility that the base coat layer, the pattern, and/or the clear coat layer are applied in a plurality of paint booths that are arranged successively along a painting line.

In an exemplary embodiment, the base coat layer, the pattern and/or the clear coat layer can be applied automatically by a multi-axis, programmable painting robot. Such painting robots are known from the prior art and need not therefore be described in more detail.

The pattern is here preferably applied by applicator that does not emit a coating agent mist, but rather emits a narrowly delimited jet of coating agent. Such applicators are known, for example, from DE 10 2010 019 612 A1, so the content of this publication should be included in full in the present description, and is hereby incorporated herein by reference in its entirety.

The base coat layer and the clear coat layer can be applied, however, by a conventional atomiser, such as for example a rotary atomiser.

It has already been mentioned above that the base coat layer, the pattern and the clear coat layer can include wet paint. However, in the context of the present disclosure, it is also possible to use a powder coat instead of wet paint for the base coat layer, the pattern, and/or the clear coat layer.

Furthermore, the present disclosure includes not merely the painting method described above. Rather, the present disclosure also includes a correspondingly constructed paint layer, e.g., on a component such as, for example, a motor vehicle bodywork component.

Finally, the present disclosure also includes a correspondingly constructed painting facility that applies the pattern to the base coat layer without an intermediate clear coat layer.

Further details of a painting facility according to the present disclosure arise from the description above, so a detailed description of the construction and function of the painting facility may be omitted here.

Further advantageous refinements of the present disclosure are characterized in the claims or described below together with the description of exemplary embodiments shown in the figures. These show:

FIG. 3 shows a cross section view through an example of a vehicle body paint that partly corresponds to the paint in FIG. 1, so to avoid repetition reference is made to the description above of FIG. 1, wherein for corresponding details the same reference numerals are used.

Figure 1:
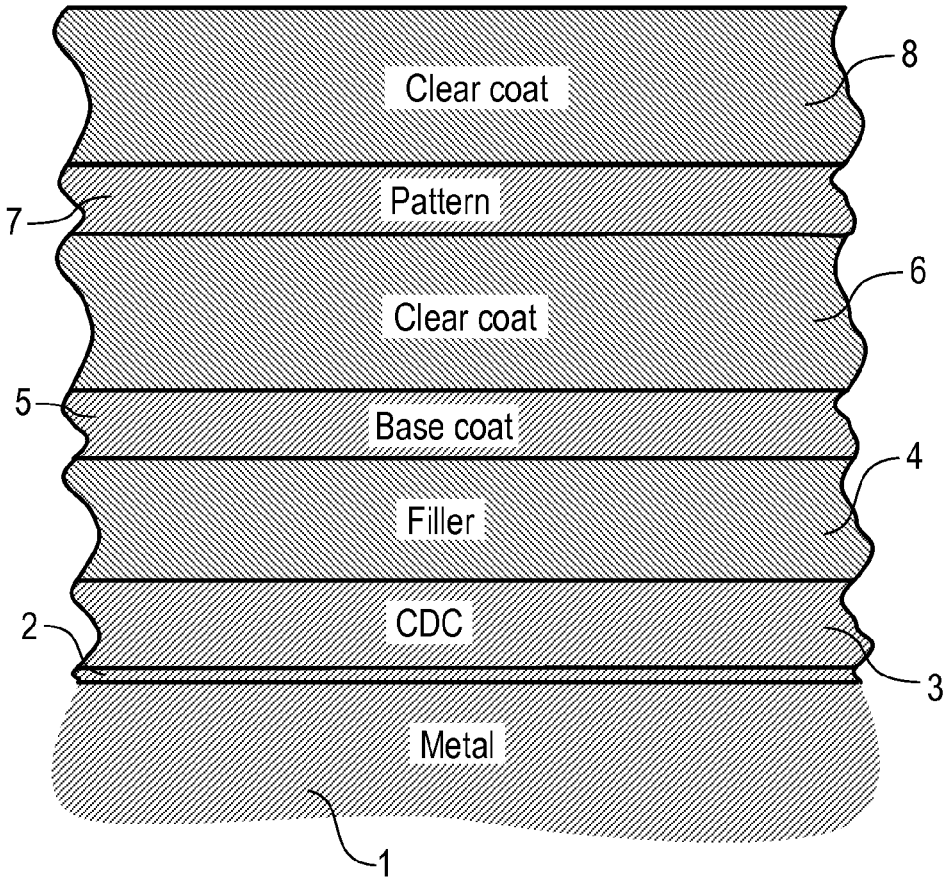
Fig. 1 Prior Art
FIG. 1 is a cross section view through a conventional motor vehicle paint with a pattern.

One feature of this vehicle paint present disclosure is that the pattern 7 (e.g., a decorative stripe) is applied directly to the base coat layer 5, i.e., without the intermediate clear coat layer 6, as in the conventional vehicle paint according to FIG. 1.

The vehicle paint according to the present disclosure therefore contains only the clear coat layer 8, while the further clear coat layer 6 previously required is not necessary. This advantageously allows the omission of two method steps for application and drying of the clear coat layer 6.

Figure 4A:
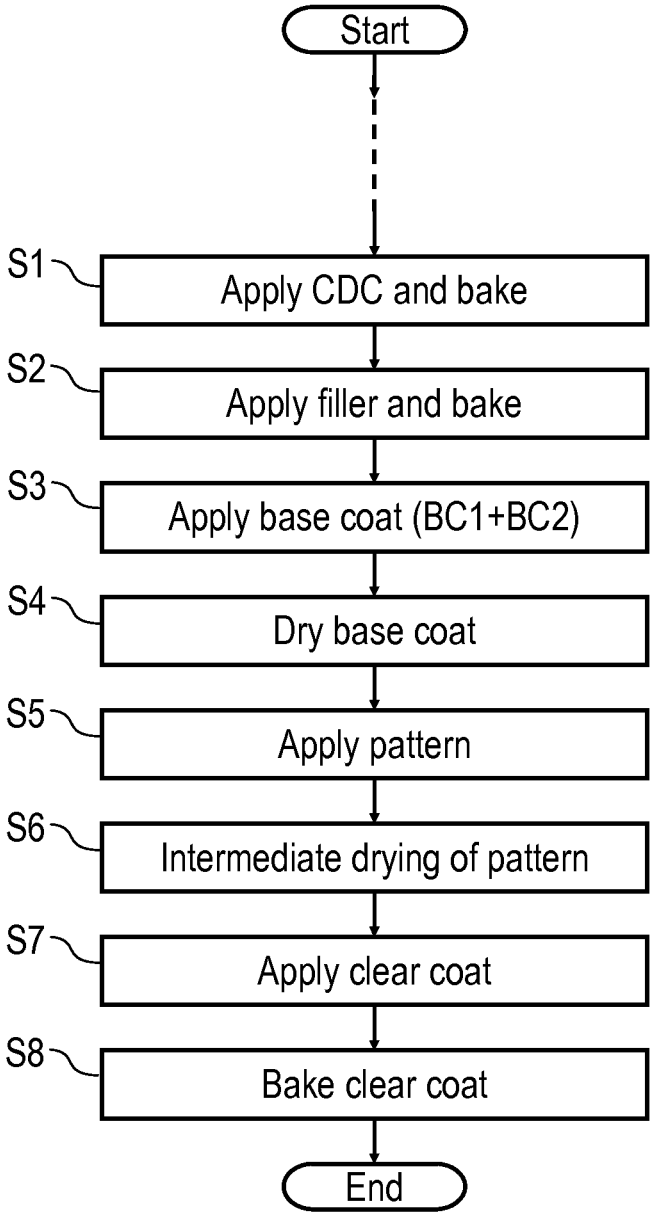
FIG. 4A is a flow diagram to illustrate an exemplary painting method.
Figure 4B:
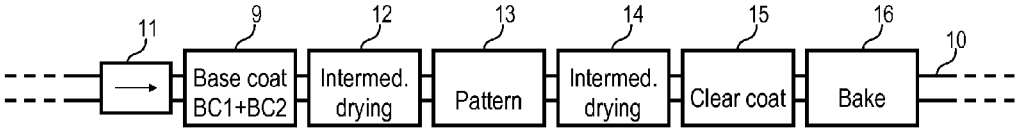
FIG. 4B is a diagrammatic depiction of an exemplary painting facility for executing the painting method according to FIG. 4A.

FIG. 4A shows as an example, in the form of a flow diagram, an exemplary painting method, while FIG. 4B shows the corresponding structure of an exemplary painting facility.

Figure 2:
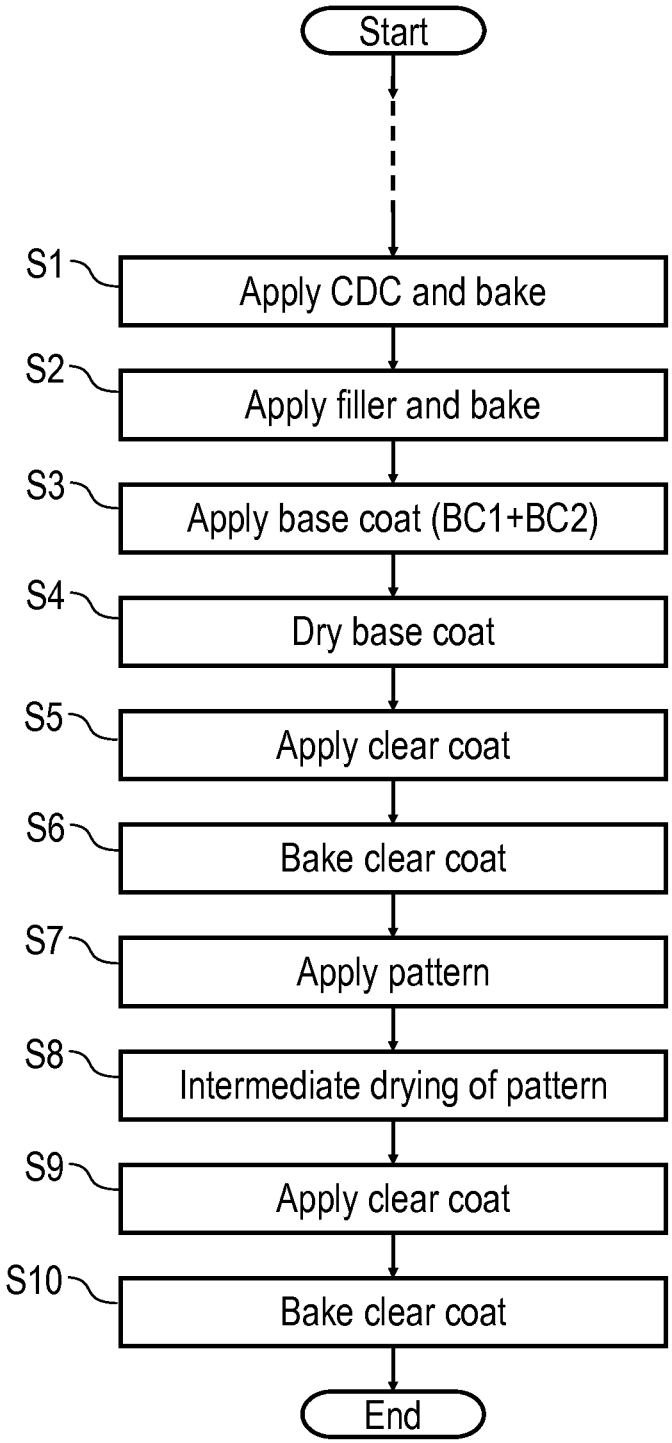
Fig. 2 Prior Art
FIG. 2 is a flow diagram of a conventional painting method for applying a pattern.
Figure 3:
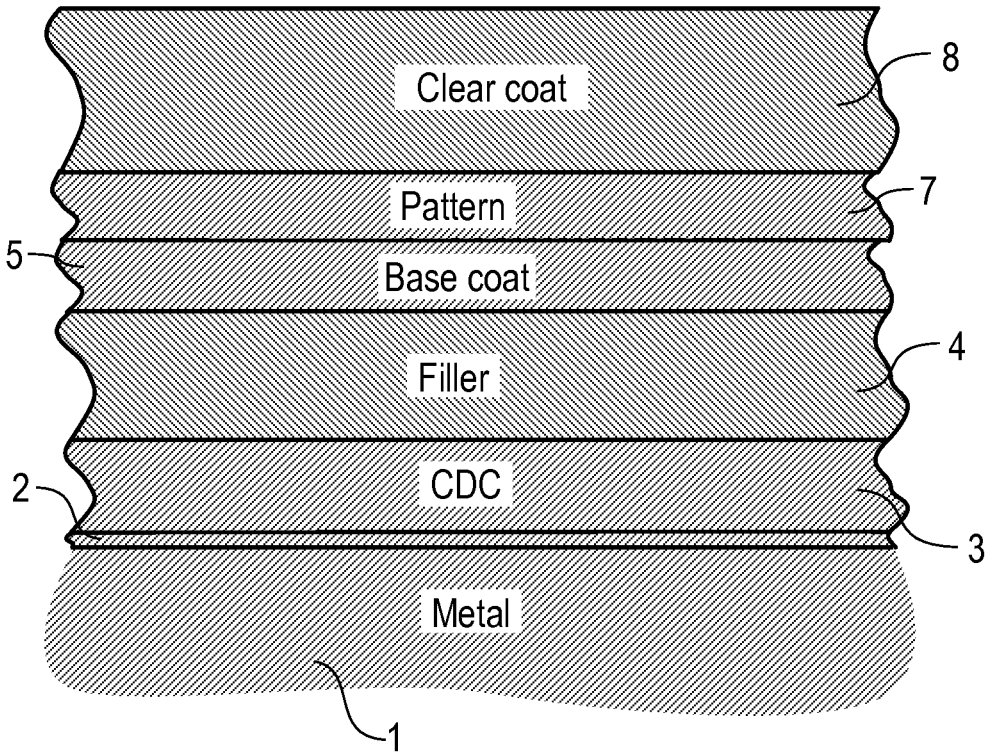
FIG. 3 is a cross section view through an example of a multi-layer paint with a pattern.

This flow diagram partially corresponds to the flow diagram of FIG. 2, so to avoid repetition reference is made to the description above, wherein for corresponding details the same reference numerals are used.

After application of the primer 3 and the filler 4 in steps S1 and S2, in step S3 the base coat layer 5 is applied. For this, the painting facility has a separate paint booth 9 in which the base coat layer 5 is applied by a multi-axis painting robot with a rotary atomiser as an applicator.

A conveyor 10, conveys motor vehicle bodywork components 11 through the painting facility in the direction of the arrow, and runs through the paint booth 1 along a paint line.

In a further step S4, the base coat layer 5 is then dried in a drying station 12.

Then in step S5, the pattern 7 is applied in a further paint booth 13. The pattern 7 is here also applied by a multi-axis painting robot carrying an applicator that does not create a coating mist but instead produces a sharply defined jet of coating agent, wherein such an applicator is known, for example, from DE 10 2010 019 612 A1.

In step S6, the pattern 7 is then dried in a drying station 14.

After the pattern 7 has dried, in step S7 the clear coat layer 8 is then applied in a further paint booth 15.

Finally, in a step S8, the clear coat layer 8 is baked in a baking station 16.

Figure 5A:
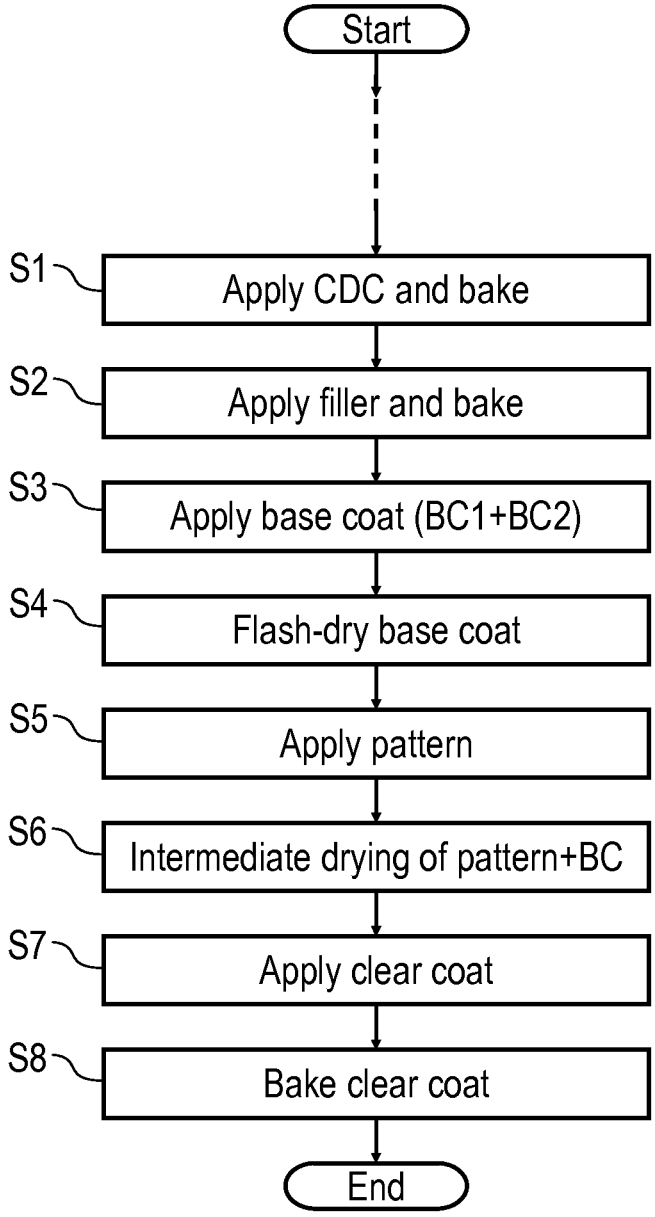
FIG. 5A is a flow diagram of another exemplary painting method.
Figure 5B:
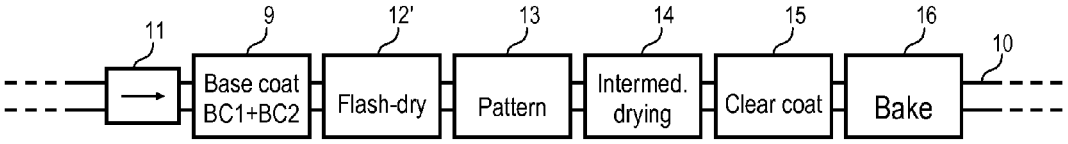
FIG. 5B is a diagrammatic depiction of an exemplary painting facility for executing the painting method according to FIG. 5A.

FIGS. 5A and 5B show a modification of the exemplary embodiment from FIGS. 4A and 4B, so to avoid repetition reference is made to the description above, wherein for corresponding details the same reference numerals are used.

One feature of this exemplary embodiment is that instead of the drying station 12, a flash-drying station 12' is provided.

Figure 6A:
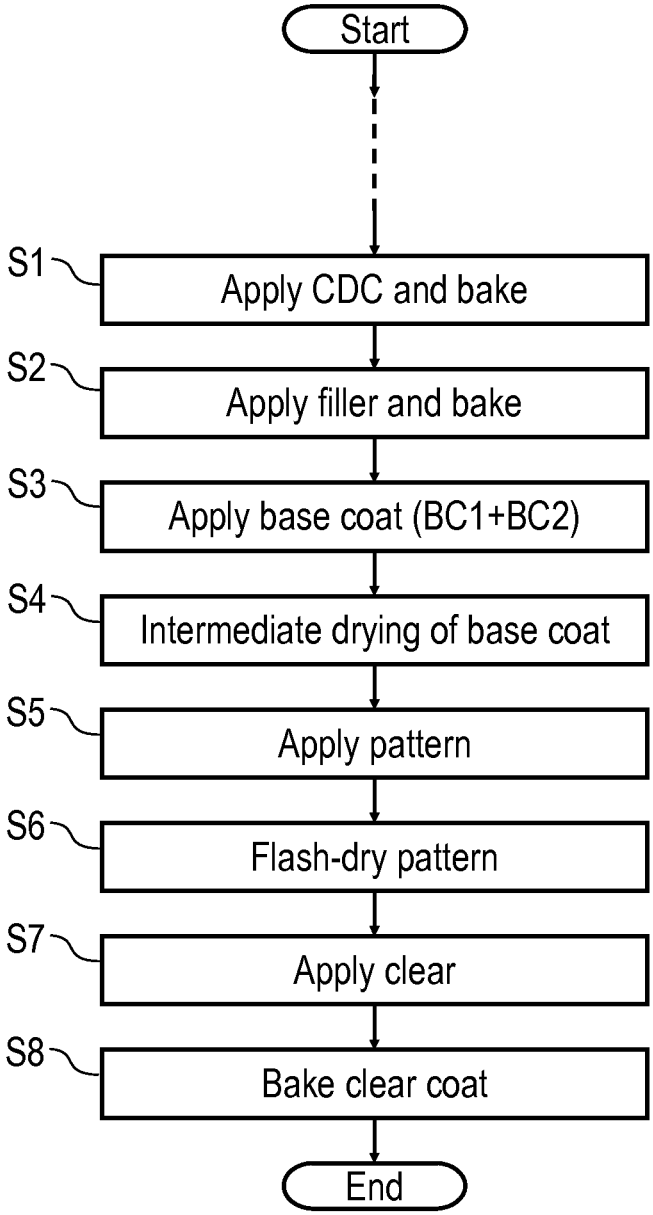
FIG. 6A is a further flow diagram of an exemplary painting method.
Figure 6B:
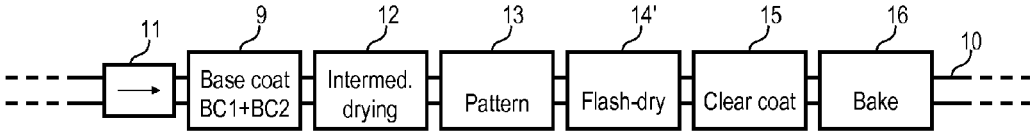
FIG. 6B is a diagrammatic depiction of an exemplary painting facility for executing the painting method according to FIG. 6A.

The exemplary embodiment according to FIGS. 6A and 6B also partially corresponds to the exemplary embodiments described above, so to avoid repetition reference is made to the description above.

One feature of this exemplary embodiment is that instead of the drying station 14 in FIG. 4B, a flash-drying station 14' is provided.

Figure 7A:
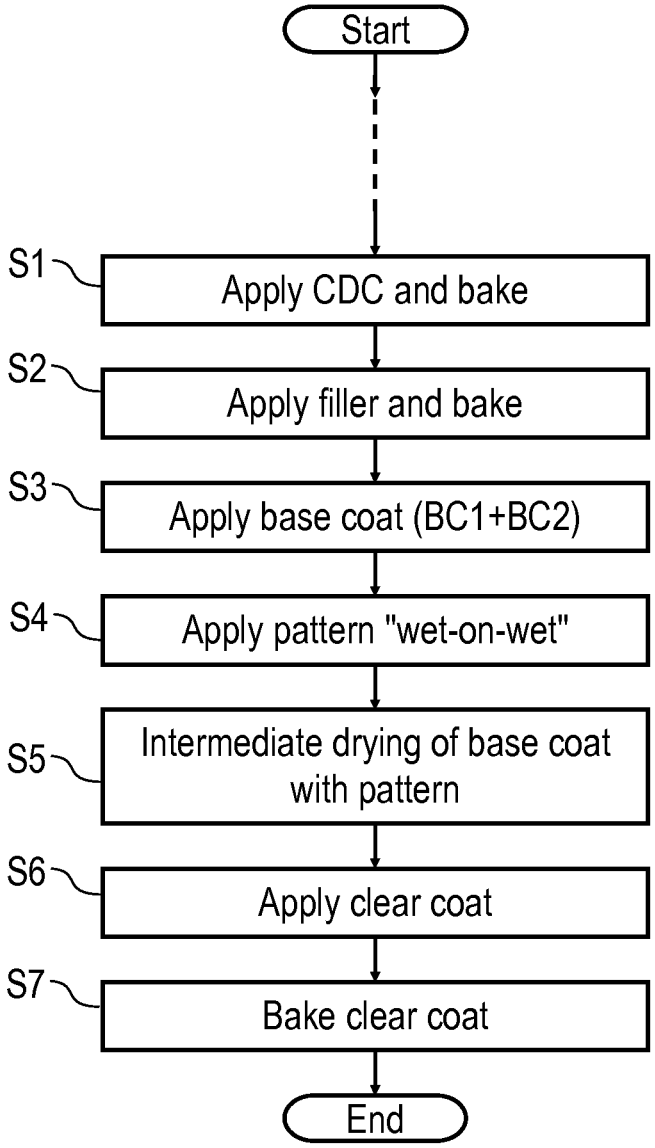
FIG. 7A is a flow diagram to illustrate an exemplary painting method.
Figure 7B:
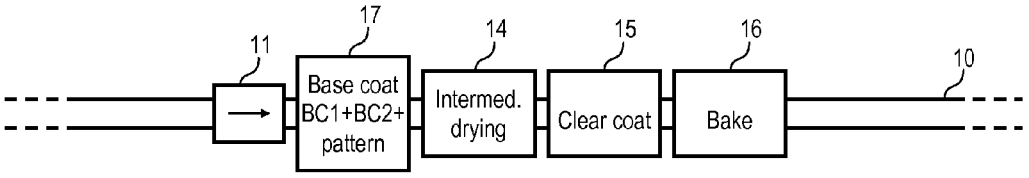
FIG. 7B is a diagrammatic depiction to of an exemplary painting facility for executing the painting method according to FIG. 7A.

The exemplary embodiment according to FIGS. 7A and 7B also partially corresponds to the exemplary embodiments described above, so to avoid repetition reference is made to the description above, wherein for corresponding details the same reference numerals are used.

One feature of this exemplary embodiment is that, in a step S4, the pattern 7 is applied "wet-on-wet" on the base coat layer 5, wherein this takes place in a common paint booth 17.

Figure 8A:
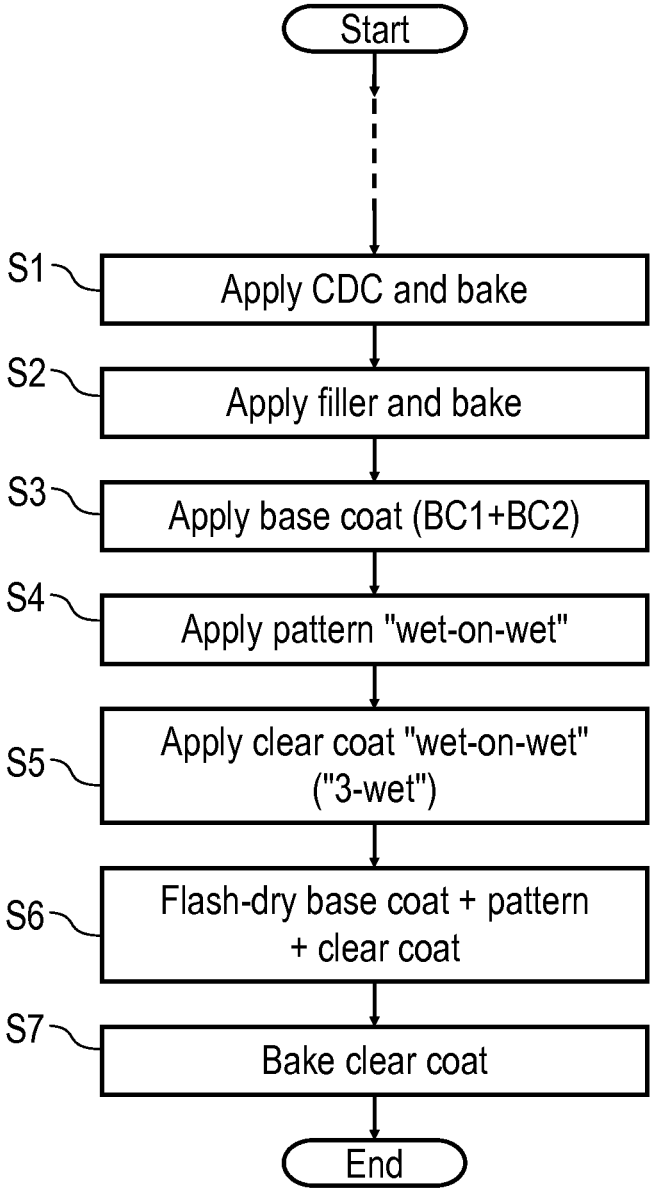
FIG. 8A is a flow diagram to illustrate an exemplary painting method with a 3-wet process for application of the pattern, FIG. 8B a diagrammatic depiction for illustrating an exemplary structure of a painting facility for executing the painting method according to FIG. 8A.
Figure 8B:
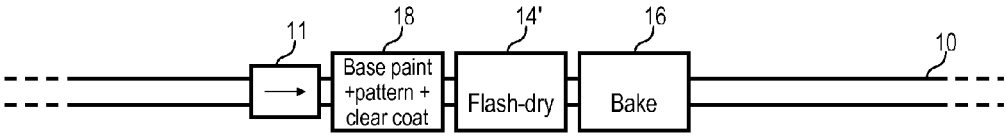

The exemplary embodiment according to FIGS. 8A and 8B also partially corresponds to the exemplary embodiments described above, so to avoid repetition reference is made to the description above, wherein for corresponding details the same reference numerals are used.

One feature of this exemplary embodiment is that the clear coat layer 8, the pattern 7 and the base coat layer 5 are applied together in a 3-wet process in the same paint booth 18.

The present disclosure is not restricted to the preferred exemplary embodiments described above. Rather, a plurality of variants and modifications are possible and therefore fall within the scope of protection claimed below. In particular, the present disclosure also includes the subject and features of the dependent claims irrespective of the claims to which they refer.

The invention claimed is:

1. A method of painting a component, comprising:

applying a single base coat layer onto the entire component;

applying a pattern directly onto the base coat layer previously applied to the component without the use of a mask, wherein the pattern is applied with a jet of coating agent that does not emit a coating agent mist;

applying a clear coat layer onto the component.

2. The method of claim 1, further comprising flash-drying of the base coat layer after application of the base coat layer and before application of the pattern.

3. The method of claim 1, further comprising intermediate drying of the base coat layer after application of the base coat layer and before application of the pattern.

4. The method of claim 1, further comprising flash-drying of the pattern after application of the pattern and before application of the clear coat layer.

5. The method of claim 1, further comprising intermediate drying of the pattern after application of the pattern and before application of the clear coat layer.

6. The method of claim 1, wherein the base coat layer and the pattern are applied wet-on-wet without intermediate drying.

7. The method of claim 1, wherein the base coat layer and the pattern and the clear coat layer are applied wet-on-wet in a 3-wet process without intermediate drying.

8. The method of claim 1, wherein the pattern and the clear coat layer are applied in separate paint booths.

9. The method of claim 1, wherein the base coat layer, the pattern and the clear coat layer are applied automatically by means of a multi-axis, freely programmable painting robot.

10. The method of claim 9, wherein the pattern is applied by an applicator which does not emit a coating agent mist but emits a narrowly delimited jet of coating agent.

11. The method of claim 10, wherein the base coat layer and the clear coat layer are applied by an atomiser.

12. The method of claim 11, wherein the base coat layer and the pattern and the clear coat layer consist of wet paint.

* * * * *